United States Patent [19]

Dunn et al.

[11] Patent Number: 4,708,679

[45] Date of Patent: Nov. 24, 1987

[54] METHOD OF MAKING SUPPORT MEANS FOR DISCHARGE LAMP TUBES

[75] Inventors: John P. Dunn, Bath; Kent L. Collins; Norman R. King, both of Hammondsport, all of N.Y.

[73] Assignee: North American Philips Lighting Corp., New York, N.Y.

[21] Appl. No.: 912,451

[22] Filed: Sep. 29, 1986

[51] Int. Cl.[4] ..... H01J 9/24

[52] U.S. Cl. ..... 445/26; 313/25

[58] Field of Search ..... 313/25, 623, 624, 625; 445/29, 26

[56] References Cited

U.S. PATENT DOCUMENTS 3,882,346 5/1973 McVey ..... 313/25 X

FOREIGN PATENT DOCUMENTS 64175 5/1977 Japan ..... 313/625

*Primary Examiner*—Kenneth J. Ramsey

*Attorney, Agent, or Firm*—Robert T. Mayer

[57] ABSTRACT

A method of forming a support wire for the arc tube of a discharge lamp wherein a cut end of the support wire is flattened to provide a smooth burr-free surface for insertion into the opening of the niobium tubes located at the ends of the arc tube of the discharge lamp.

3 Claims, 5 Drawing Figures

FIG.1
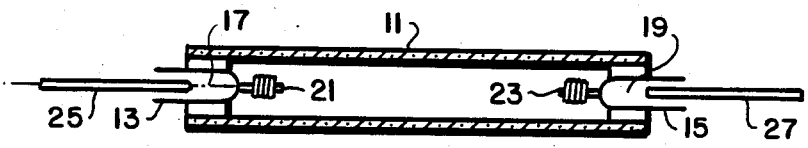
FIG.2
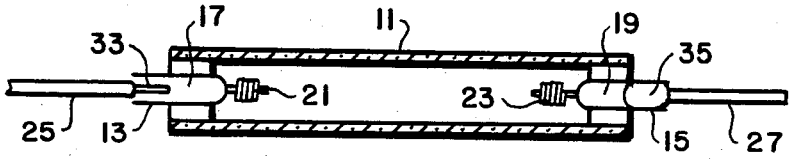
FIG.3
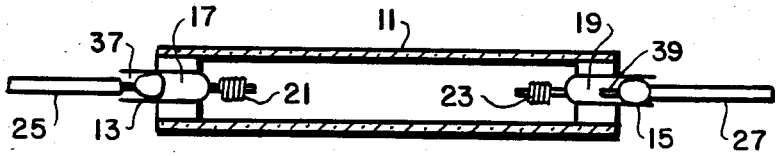
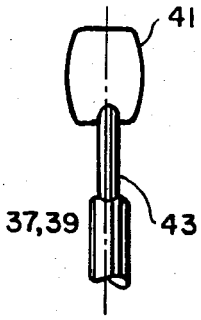
FIG.4a
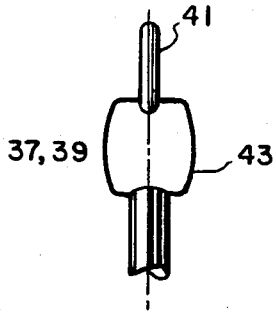
FIG.4b

METHOD OF MAKING SUPPORT MEANS FOR DISCHARGE LAMP TUBES

This is an invention in the lighting arts. More particularly, it involves a novel method for fabricating the ends of support wires for discharge tubes.

This application is related to our application entitled "Arc Tube Wire Support" filed concurrently herewith and assigned to the assignee of this application. That application is incorporated by reference herein.

In high-pressure discharge lamps the arc tubes are typically held in place by support wires. In addition to supporting the tubes, these wire also serve as locating elements. A novel locating and supporting arrangement is shown in copending application Ser. No. 810,804 assigned to the assignee of this application. As shown in that application, the locating and supporting wires are inserted into the open ends of the niobium tubes which form part of the electrode structure for the lamps. In the past, the difference between the external dimension of the wire support and the internal dimension of the niobium tube allowed for lateral movement of the tubes about the wire. Because the wires forming the supports are cut to a prescribed length from a supply of wire, the ends of the wires invariably have burrs formed in them where they are cut. To keep these burrs to a minimum and thereby prevent damage to the niobium tubes, extra effort has been made in the past in designing cutting tools including making certain the cutting edge is kept sharp.

It is an object of the invention to provide improved discharge lamps.

It is another object of this invention to eliminate burrs from the ends of support wires for discharge lamps.

One of the features of the invention is the manner in which burr-free ends are obtained on discharge lamp support wires. Any burrs on the ends of the wires are removed by expanding the ends. Support wires with expanded ends provide more lateral support for their respective discharge lamps.

One of the advantages of the invention is that the lack of burrs prevents the support wire from snagging on the interior wall of the opening in the niobium tube. Thus freer movement in operational expansion and contraction is provided by the invention.

In carrying out the invention, there is provided a method of making a support means for the discharge means of a high-pressure discharge lamp. The method includes cutting a prescribed length of support wire from a supply of such wire to form the support means. A cut end of said wire is intended for insertion in an opening in the tubular electrode structure formed at one end of the discharge means. The method further includes flattening the cut end to make it burr-free and of an width smaller than the internal dimension of the opening. The width of the flattened cut end is close enough to the internal dimension of the opening to provide more lateral support for the discharge means than would be provided by the unflattened cut end. The external dimension is made such as to maintain sufficient clearance with the opening to allow for operational expansion and contraction of the wire and the discharge means.

Other objects, features and advantages of the invention will be apparent to those skilled in the art from the following description and appended claims when considered in conjunction with the accompanying drawing in which:

FIG. 1 is a partial view of a prior art high-pressure discharge lamp;

FIG. 2. is a partial view of a high-pressure discharge lamp made in accordance with the invention;

FIG. 3 is a partial view of another high-pressure discharge lamp also made in accordance with the invention; and FIGS. 4*a* and 4*b* are orthogonally arranged views of a part of the embodiment of the high-pressure discharge lamp of FIG. 3.

The drawing is not to scale. Similar elements of the structure disclosed are identified by the same reference characters in the various figures of the drawing.

Referring to FIG. 1 of the drawing there is shown a prior art lamp with discharge means in the form of an arc tube 11 having electrode structures 13 and 15 at each of its ends. As is typical these structures include niobium tubes 17 and 19 and electrodes 21 and 23. The support means for arc tube 11 includes support wires 25 and 27 each cut to a prescribed length from a supply of such wire. The lengths of wires 25 and 27 could be different depending on the lamp design. Wires 25 and 27 are depicted as two separate wires but could be two ends of a single prescribed length of support wire which would later be cut in two.

In the FIG. 1 prior art embodiment the ends of support wires 25 and 27 are inserted in the open ends of niobium tubes 17 and 19 in order to provide support and alignment for the tubes.

FIG. 2 shows an arrangement which is an improvement over FIG. 1. In accordance with the invention the ends of support wires 25 and 27 are crimped in the FIG. 2 embodiment to form flat portions 33 and 35. In crimping wires 25 and 27 any burrs formed in the cutting of the wires are removed to leave portions 33 and 35 smooth and burr-free. It is to be understood that the edges of flat portions 33 and 35 are so disposed that they are at approximately right angles to each other. Flat portions 33 and 35 comprise expanded end means which can provide center line alignment between arc tube 11 and support wires 25 and 27. The expanded end means also provide more lateral support than wires 25 and 27 would provide without such expanded end means.

FIG. 3 shows the presently preferred embodiment of the invention. In this embodiment flat portions 33 and 35 of the arrangement of FIG. 2 are replaced by dual flattened end portions 37 and 39. As can be seen from FIGS. 4*a* and 4*b* each of these axial sections comprises two flattened portions 41 and 43 with rounded edges disposed at approximately right angles to each other. Flattened portions 41 and 43 are readily provided at the ends of wires 25 and 27 by crimping the ends of these wires as desired. It is contemplated that more than two flattened portions could be provided at the ends of each of wires 25 and 27. If so these might be arranged at different angles from the 90° angle shown in FIGS. 4*a* and 4*b*.

From the foregoing it can be seen that in practicing the invention the support wires of a discharge lamp are provided with smooth edges for contacting the inside of the niobium tubes at the ends of the arc tube of a discharge lamp.

A constructed embodiment of a lamp made in accordance with the invention uses a 0.0625 inch diameter nickel plated steel wire which is compressed from four sides until dual flattened end portions such as 37, 39 are formed. Each portion 41 and 43 is between 0.080 and 0.090 inches wide and 0.035 inches thick with rounded edges having a 0.200 inch radius. The length of both portions from the bottom most part of portion 43 as seen in FIG. 4*a* to the top of portion 41 is 0.188 inches. The total length of portion 41 as shown in FIG. 4B is 0.104 inches nominally. This support is designed for use with a niobium tube with the openings at its end each having a nominal internal diameter of 0.098 inches.

It is understood that various modifications to the above-described method may become evident to those skilled in the art and that the method described herein is for illustrative purposes and is not to be considered restrictive.

What is claimed is:

1. A method of making a support means for the discharge means of a high-pressure discharge lamp including cutting a prescribed length of support wire from a supply of such wire to form said support means, a cut end of said wire being intended for insertion in an opening in a tubular electrode structure formed at one end of said discharge means and flattening said cut end to make it burr-free and of an increased width smaller than the internal dimension of said opening, said flattened end providing more lateral support for said discharge means than would be provided by the unflattened cut end, said width maintaining sufficient clearance with said opening to allow for operational expansion and contraction of said wire and said discharge means.

2. A method according to claim 1 wherein said cut end is flattened in two adjacent axial sections each section having rounded edges and being disposed at approximately 90° to the other as viewed along the axis of said wire.

3. A method according to claim 1 wherein said cut end is flattened in at least two adjacent axial sections disposed angularly with respect to each other as viewed along the axis of said wire.

* * * * *